US006093217A

United States Patent [19]

Frölich et al.

[11] Patent Number: 6,093,217

[45] **Date of Patent: *Jul. 25, 2000**

[54] SIZING OF PAPER

[75] Inventors: Sten Frölich, Askim; Erik Lindgren, Bohus; Rein Sikkar, Floda, all of Sweden

[73] Assignee: Akzo Nobel N.V., Arnhem, Netherlands

[ * ] Notice: This patent is subject to a terminal disclaimer.

[21] Appl. No.: 09/017,915

[22] Filed: Feb. 3, 1998

Related U.S. Application Data

[60] Provisional application No. 60/038,432, Feb. 19, 1997.

[30] Foreign Application Priority Data

| | | | |
|---|---|---|---|
| Feb. 5, 1997 | [EP] | European Pat. Off. | 97850016 |
| Feb. 5, 1997 | [EP] | European Pat. Off. | 97850017 |
| Dec. 30, 1997 | [SE] | Sweden | 9704930 |

[51] Int. Cl.[7] ..... C08L 1/10; D21H 17/17; D21H 17/27; D21H 17/25

[52] U.S. Cl. ..... 8/115.6; 106/170.4; 106/170.47; 8/116.1; 8/181

[58] Field of Search ..... 8/115.6, 116.1, 8/181; 106/170.4, 170.47

[56] References Cited

U.S. PATENT DOCUMENTS

| | | | |
|---|---|---|---|
| 2,661,349 | 12/1953 | Caldwell et al. | 260/224 |
| 3,102,064 | 8/1963 | Wurzburg et al. | 162/158 |
| 3,720,663 | 3/1973 | Tessler | 260/233.5 |
| 3,887,427 | 6/1975 | Helmer et al. | 162/158 |
| 4,020,272 | 4/1977 | Tessler | 536/107 |
| 4,222,820 | 9/1980 | Hiskens et al. | 162/158 |
| 4,228,277 | 10/1980 | Landoll | 536/90 |
| 4,239,592 | 12/1980 | Gaspar et al. | 162/175 |
| 4,243,802 | 1/1981 | Landoll | 536/91 |
| 4,522,686 | 6/1985 | Dumas | 162/158 |
| 4,687,519 | 8/1987 | Trzasko et al. | 106/211 |
| 4,952,684 | 8/1990 | Yalpani et al. | 536/18.7 |
| 4,963,664 | 10/1990 | Yalpani et al. | 536/18.7 |
| 5,114,539 | 5/1992 | Penniman et al. | 162/184 |
| 5,314,721 | 5/1994 | Müller et al. | 427/386 |
| 5,969,011 | 10/1999 | Frolich et al. . | |

FOREIGN PATENT DOCUMENTS

| | | | |
|---|---|---|---|
| 0 186 956 | 7/1986 | European Pat. Off. | D21D 3/00 |
| 0 512 319 | 11/1992 | European Pat. Off. | C08B 5/00 |
| 0 551 817 | 7/1993 | European Pat. Off. | C08F 2/28 |
| 0 748 897 | 12/1996 | European Pat. Off. | D12H 23/04 |
| WO 94/24169 | 10/1994 | WIPO | C08B 11/15 |

OTHER PUBLICATIONS

*Partial International Search Report*, PCT/SE98/00191, dated May 25, 1998.

*Primary Examiner*—Margaret Einsmann
*Attorney, Agent, or Firm*—Ralph J. Mancini; Lainie E. Parker

[57] ABSTRACT

The invention relates to an aqueous dispersion containing a cellulose-reactive sizing agent and an anionic hydrophobically modified cellulose-derivative, its preparation and use in the production of paper. The invention also relates to a substantially water-free composition containing a cellulose-reactive sizing agent and an anionic hydrophobicity modified cellulose-derivative, its preparation and use in the preparation of an aqueous dispersion cellulose-reactive sizing agent. The invention further relates to a process for sizing cellulosic fibers by addition of an aqueous sizing dispersion containing a cellulose-reactive sizing agent and a hydrophobically modified dispersing agent to a stock containing cellulosic fibers, and optional fillers, and dewatering the stock on a wire to obtain a web containing cellulosic fibers.

10 Claims, No Drawings

SIZING OF PAPER

This application claims the benefit of U.S. Provisional application Ser. No. 60/038,432, filed Feb. 19, 1997.

This invention relates to sizing of paper and more specifically to aqueous dispersions containing a cellulose-reactive sizing agent and a hydrophobically modified dispersing agent, their preparation and use.

BACKGROUND

Cellulose-reactive sizing agents, such as those based on alkyl ketene dimer (AKD) and alkenyl succinic anhydride (ASA), are widely used in papermaking at neutral or slightly alkaline stock pH's in order to give paper and paper board some degree of resistance to wetting and penetration by aqueous liquids. Paper sizes based on cellulose-reactive sizing agents are generally provided in the form of dispersions containing an aqueous phase and finely divided particles or droplets of the sizing agent dispersed therein. The dispersions are usually prepared with the aid of a dispersant system consisting of an anionic compound, e.g. sodium lignosulfonate, in combination with a high molecular weight cationic or amphoteric polymer, e.g. cationic starch, polyamine, polyamideamine or a vinyl addition polymer. Depending on the overall charge of the compounds of the dispersant system, the size dispersions will be cationic or anionic in nature.

Cellulose-reactive sizing agents generally provide good sizing with low dosages of the sizing agent. However, it has been experienced that the efficiency of conventional cellulose-reactive sizing agents is deteriorated when they are used with stocks having a high cationic demand and containing a substantial amount of lipophilic wood extractives, such as, for example, resin acids, fatty acids, fatty esters, triglycerides, etc. Due to the anionic character of lipophilic substances containing carboxylate or carboxylic acid groups, stocks containing a substantial amount of lipophilic extractives usually have a rather high cationic demand, it has been found that the lipophilic substances can be detrimental to the adsorption of sizing agents onto the fibers which may cause the poor sizing results. In order to improve sizing with such stocks the papermaker has had to increase the dosage of sizing agent, which of course is less favourable economically and can increase the accumulation of sizing agent in the white water recirculating in the papermaking process. These problems are even more pronounced in paper mills where white water is extensively recirculated with the introduction of only low amounts of fresh water into the process, thereby further increasing the cationic demand and the accumulation of lipophilic extractives and non-retained sizing agent in the white water and the stock to be dewatered.

It is accordingly an object of this invention to provide improved dispersions of cellulose-reactive sizing agent and processes resulting in improved sizing where dispersions of cellulose-reactive sizing agent are used with cellulosic stocks having a high cationic demand and/or a high content of lipophilic extractives and/or processes with extensive white water recirculation.

THE INVENTION

According to the present invention it has been found that improved sizing can be obtained by using aqueous dispersions of cellulose-reactive sizing agent having a hydrophobe-modified dispersing agent in the internal sizing of stocks having a high cationic demand and/or containing high levels of lipophilic substances. It has also been found that improved sizing can be obtained by using such dispersions in papermaking processes where white water is extensively recirculated, thereby creating conditions of high cationic demand and/or high contents of lipophilic extractives. Accordingly, the invention generally relates to the use of an aqueous sizing dispersion containing a cellulose-reactive sizing agent and a hydrophobically modified dispersing agent in the internal sizing of difficult-to-size stocks by addition of sizing dispersion to a stock containing cellulosic fibers, and optional fillers, dewatering the stock on a wire to obtain a web containing cellulosic fibers, or paper. In a first aspect of the invention, the stock has a cationic demand of at least 50 $\mu$eq/liter stock filtrate. In a second aspect of the invention, the stock has a content of lipophilic substances of at least 10 ppm. A third aspect of the invention comprises dewatering the stock on a wire to obtain white water and a web containing cellulosic fibers, recirculating the white water, and optionally introducing fresh water, to form a stock containing cellulosic fibers to be dewatered, wherein the amount of fresh water introduced is less than 30 tons per ton of dry cellulosic product produced. The invention thus relates to the use of an aqueous sizing dispersion containing a cellulose-reactive sizing agent and a hydrophobically modified dispersing agent in a process for sizing cellulosic fibers, as further defined in the claims.

In a preferred embodiment of this invention, the aqueous dispersion contains a cellulose-reactive sizing agent and an anionic hydrophobe-modified dispersing agent, notably an anionic hydrophobically modified cellulose-derivative, and this invention further relates to such a dispersion and its preparation, as further defined in the claims. The dispersion provides improved stability and sizing characteristics and it is particularly useful with papermaking stocks having a high cationic demand and containing lipophilic substances, notably with a high degree of white water closure.

The invention makes it possible to produce paper with improved sizing over conventional sizing dispersions at a corresponding dosage of cellulose-reactive sizing agent and to use a lower dosage of cellulose-reactive sizing agent to attain a corresponding level of sizing. The possibility of using lower amounts of sizing agent to attain in-specification sizing reduces the risk of accumulation of non-adsorbed sizing agent in the white water recirculating in the process, thereby reducing the risk of aggregation and deposition of the sizing agent on the paper machine. The invention thus offers substantial economic and technical benefits.

The cellulose-reactive sizing agent according to the invention can be selected from any of the cellulose-reactive sizing agents known in the art. Suitably the sizing agent is selected from the group consisting of hydrophobic ketene dimers, ketene multimers, acid anhydrides, organic isocyanates, carbamoyl chlorides and mixtures thereof, preferably ketene dimers and acid anhydrides, most preferably ketene dimers. Suitable ketene dimers have the general formula (I) below, wherein $R^1$ and $R^2$ represent saturated or unsaturated hydrocarbon groups, usually saturated hydrocarbons, the hydrocarbon groups suitably having from 8 to 36 carbon atoms, usually being straight or branched chain alkyl groups having 12 to 20 carbon atoms, such as hexadecyl and octadecyl groups. Suitable acid anhydrides can be characterized by the general formula (II) below, wherein $R^3$ and $R^4$ can be identical or different and represent saturated or unsaturated hydrocarbon groups suitably containing from 8 to 30 carbon atoms, or $R^3$ and $R^4$ together with the —C—O—C— moiety can form a 5 to 6 membered ring, optionally being further substituted with hydrogen groups containing up to 30 carbon atoms. Examples of acid anhydrides which are used commercially include alkyl and alkenyl succinic anhydrides and particularly isooctadecenyl succinic anhydride.

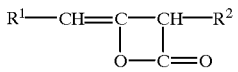

(I)

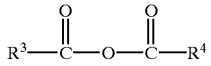

(II)

Suitable ketene dimers, acid anhydrides and organic isocyanates include the compounds disclosed in U.S. Pat. No. 4,522,686, which is hereby incorporated herein by reference. Examples of suitable carbamoyl chlorides include those disclosed in U.S. Pat. No. 3,887,427 which is also incorporated herein by reference.

In addition to the cellulose-reactive sizing agent, the size dispersions may also contain a non-cellulose-reactive sizing agent. Examples of suitable sizing agents of this type include rosins, e.g. fortified and/or esterified rosin, waxes, fatty acid and resin acid derivatives, e.g. fatty amides and fatty esters, e.g. glycerol triesters of natural fatty acids.

The dispersion used according to the invention contains a hydrophobically modified dispersing agent, i.e. a dispersing agent having one or more hydrophobic groups. Preferably the hydrophobic group is pendent, i.e. being attached to the dispersing agent in the form of a hydrophobic side-chain. Examples of suitable groups include hydrophobic substituents containing at least 4, suitably at least 6 and preferably from about 8 to about 30 carbon atoms, notably hydrophobic amide, ester and ether substituents comprising a saturated or unsaturated hydrocarbon chain of at least 4, suitably at least 6 and preferably from 8 to 30 carbon atoms, optionally being interrupted by a heteroatom, e.g. oxygen or nitrogen, and/or a group containing a heteroatom, e.g. carbonyl or acyloxy. The dispersing agent can have a degree of hydrophobic substitution ($DS_H$) of from 0.01 to 0.8, suitably from 0.02 to 0.5 and preferably from 0.03 to 0.4.

The hydrophobically modified dispersing agent may be charged or uncharged, preferably it is charged and contains one or more ionic groups of the same or different types. The ionic groups can be cationic and/or anionic. Accordingly, the dispersing agent can be anionic, amphoteric or cationic in nature, preferably amphoteric or anionic, preferably anionic. Suitable anionic groups include sulfate groups and carboxylic, sulfonic, phosphoric and phosphonic acid groups which may be present as free acid or as water-soluble ammonium or alkali metal (generally sodium) salts, e.g. sodium carboxylates and sulfonates. The dispersing agent can have a degree of ionic substitution varying over a wide range; the degree of anionic substitution ($DS_A$) can be from 0.01 to 1.4, suitably from 0.1 to 1.2 and preferably from 0.2 to 1.0. The degree of cationic substitution ($DS_C$) can be from 0.01 to 1.0, suitably from 0.1 to 0.8 and preferably from 0.2 to 0.6.

The dispersing agent can be derived from synthetic and natural sources and it is preferably water-soluble or water-dispersable. Examples of suitable dispersing agents include hydrophobically modified polysaccharides such as, for example, starches, guar gums, celluloses, chitins, chitosans, glycans, galactans, glucans, xanthan gums, mannane, dextrins, etc., preferably starches, guar gums and cellulose derivatives, suitably anionic and cationic derivatives and preferably anionic derivatives like phosphated, sulfonated and carboxylated polysaccharides, hydrophobically modified polymeric condensation products such as, for example, anionic and cationic polyurethanes, cationic polyamidoamines; hydrophobe-modified anionic and cationic vinyl addition polymers such as, for example, polymers based on (meth)acrylamide, (meth)acrylates, vinyl carboxyates, and the like. The hydrophobically modified synthetic polymers can easily be prepared by employing in the polymerization monomers having a hydrophobic substituent, e.g. hydrophobic chain alkyl (meth)acrylamides and (meth)acrylates, vinyl stearate, etc., and optional anionic and/or cationic monomers.

Examples of suitable hydrophobically modified and charged dispersing agents include those disclosed in U.S. Pat. Nos. 4,228,277; 4,239,592 and 4,687,519; European Pat. Appl. Nos. 189 319; 512 319 and 551 817; and International Pat. Appl. Publ. No. WO 94/24169, which are hereby incorporated herein by reference. The dispersions used according to this invention can be prepared in conventional manner with the exception that the dispersing agent is hyrophobically modified.

The amount of hydrophobically-modified dispersing agent present in the dispersion can be varied over a broad range depending on, among other things, type of material and its $DS_H$ and, if charged, the $DS_A$, the $DS_C$, type of sizing agent, desired anionicity, cationicity and solids content of the resulting dispersion. The hydrophobically modified dispersing agent can be present in the dispersion in an amount of up to 100% by weight, usually from 0.1 to 20% by weight, suitably from 0.2 to 10% by weight and preferably from 0.3 to 6% by weight, based on the sizing agent.

In a preferred embodiment of this invention, the size dispersion contains a hydrophobe-modified dispersing agent, as described above, and a surfactant. This surfactant, when employed, may be anionic, non-ionic or cationic in nature. Surfactants to be employed should suitably have HLB values ranging from about 8 to about 30 or higher, and preferably from about 8–25.

Suitable cationic surfactants include any cationic compound which is capable of functioning as a surfactant and/or as a coupling agent between the particle or droplet of sizing agent and the hydrophobe-modified cellulose-derivative. Preferred surfactants include ammonium compounds having the general formula $R_4N^+ X^-$, wherein each R group is independently selected from (i) hydrogen, (ii) hydrocarbon groups, suitably aliphatic and preferably alkyl groups, having from 1 to about 30 carbon atoms, preferably from 1 to 22 carbon atoms; and (iii) hydrocarbon groups, suitably aliphatic and preferably alkyl groups, having up to about 30 carbon atoms, preferably from 4 to 22 carbon atoms, and being interrupted by one or more heteroatoms, e.g. oxygen or nitrogen, and/or groups containing a heteroatom, e.g. carbonyl and acyloxy groups; suitably at least three and preferably all of said R groups containing carbon atoms; suitably at least one and preferably at least two of said R groups containing at least 9 carbon atoms and preferably at least 12 carbon atoms; and wherein $X^-$ is an anion, typically a halide, e.g. chloride. Examples of suitable surfactants include dioctyldimethylammonium chloride, didecyldimethylammonium chloride, dicocodimethylammonium chloride, cocobenzyldimethylammonium chloride, coco (fractionated)benzyldimethylammonium chloride, octadecyl trimethylammonium chloride, dioctadecyl dimethylammonium chloride, dihexadecyl dimethylammonium chloride, di(hydrogenated tallow)dimethylammonium chloride, di(hydrogenated tallow)benzylmethylammonium chloride, (hydrogenated tallow)benzyldimethylammonium chloride, dioleyldimethylammonium chloride, and di(ethylene hexadecanecarboxylate)dimethylammonium chloride. Particularly preferred cationic surfactants thus include those containing at least one hydrocarbon group with from 9 to 30 carbon atoms and notably quaternary ammonium compounds. Further preferred cationic surfactants include quaternary di- and polyammonium compounds containing at least one hydrocarbon group, suitably aliphatic and preferably alkyl, with from 9 to 30 carbon atoms, preferably from 12 to 22 carbon atoms. Examples of suitable surfactants of this type include N-octadecyl-N-dimethyl-N'-trimethylpropylene-diammonium dichloride. Suitably the cationic surfactant has a molecular weight between about 200 and about 800. Suitable anionic surfactants include alkyl, aryl and alkylaryl sulfates and ethenesulfates, alkyl, aryl and alkylaryl carboxylates, alkyl, aryl and alkylaryl sulfonates, alkyl, aryl and alkylaryl phosphates and etherphosphates, and dialkyl sulfosuccinates, the alkyl group shaving from 1 to 18 carbon atoms, the aryl group shaving from 6 to 12 carbon atoms, and the alkylaryl groups having from from 7 to 30 carbon atoms. Suitable anionic surfactants include sodium lauryl sulfate, sodium lauryl sulfonate and sodium dodecylbenzxenesulfonate.

When being used, the surfactant can be present in the dispersion in an amount of from 0.1 to 20% by weight, suitably from 1 to 10% by weight and preferably from 2 to 7% by weight, based on the sizing agent. In a preferred embodiment, the size dispersion contains an anionic hydrophobe-modified dispersing agent and a cationic surfactant. Preferably this size dispersion is anionic in nature, i.e. the anionic dispersing agent is present in ionic excess. In another preferred embodiment, the size dispersion contains a cationic hydrophobe-modified dispersing agent and an anionic surfactant. Preferably this size dispersion is cationic, i.e. the cationic dispersing agent is present in ionic excess.

The sizing dispersions can be added to the paper making stock in conventional manner. The term "paper", as used herein, is meant to include not only paper but all types of cellulose-based product in sheet and web form, including, for example, board and paperboard. The stock contains cellulosic fibers, optionally in combination with mineral fillers, and usually the content of cellulosic fibers is at least 50% by weight, based on dry stock. Examples of mineral fillers of conventional types include kaolin, china clay, titanium dioxide, gypsum, talc and natural and synthetic calcium carbonates such as chalk, ground marble and precipitated calcium carbonate. Suitably the amount of cellulose-reactive sizing agent added to the stock is from 0.01 to 1.0% by weight, based on the dry weight of cellulosic fibers and optional fillers, preferably from 0.05 to 0.5% by weight, where the dosage is mainly dependent on the quality of the pulp or paper to be sized, the sizing agent used and the level of sizing desired.

The size dispersions are used in stock sizing of cellulosic pulp where the stock has a high cationic demand and/or contains substantial amounts of lipophilic substances, e.g. stocks prepared from certain grades of wood-containing and recycled pulps, for example where recirculation of white wafer is extensive. Usually the cationic demand is at least 50, suitably at least 100 and preferably at least 150 $\mu$eq/liter stock filtrate. The cationic demand can be measured in conventional manner, for example by means of a Mütek Particle Charge Detector using a stock filtrate obtained from a raw stock filtered through a 1.6 $\mu$m filter and poly (diallyldimethylammonium chloride) as a titrant. The amount of lipophilic substances may be at least 10 ppm, usually at least 20 ppm, suitably at least 30 ppm and preferably at least 50 ppm, measured as ppm DCM by means of extraction using DCM (dichloromethane) in known manner. Further, the present dispersions are preferably used in papermaking processes where white water is extensively recirculated, i.e. with a high degree of white water closure, for example where from 0 to 30 tones of fresh water are used per ton of dry paper produced, usually less than 20, suitably less than 15, preferably less than 10 and notably less than 5 tones of fresh water per tone of paper. Recirculation of white water in the process preferably takes place by mixing the white water with cellulosic fibers, preferably in the form of a stock or suspension, before or after the addition of the sizing dispersion, e.g. to form the stock to be dewatered. Fresh water can be introduced in the process at any stage; for example, it can be mixed with cellulosic fibers in order to form the stock, and it can be mixed with a stock containing cellulosic fibers to dilute it so as to form the stock to be dewatered, before or after mixing the stock with white water and before or after the addition of the sizing dispersion.

Chemicals conventionally added to the stock in papermaking such as retention aids, aluminum compounds, dyes, wet-strength resins, optical brightening agents, etc., can of course be used in conjunction with the present size dispersions. Examples of aluminum compounds include alum, aluminates and polyaluminum compounds, e.g. polyaluminum chlorides and sulphates. Examples of suitable retention aids include cationic polymers, anionic inorganic materials in combination with organic polymers, e.g. bentonite in combination with cationic polymers, silica-based sols in combination with cationic polymers or cationic and anionic polymers. Particularly good stock sizing can be obtained when using the dispersions of the invention in combination with retention aids comprising cationic polymers. Suitable cationic polymers include cationic starch guar gum, acrylate and acrylamide-based polymers, polyethyleneimine, dicyandiamide-formaldehyde, polyamines, polyamidoamines and poly(diallyldimethyl ammoniumchloride) and combinations thereof. Cationic starch and cationic acrylamide-based polymers are preferably used, either alone or in combination with each other or with other materials. In a preferred embodiment of the invention, the dispersions are used in combination with a retention system comprising at least one cationic polymer and anionic silica-based particles. The present dispersions can be added before, between, after or simultaneously with the addition of the cationic polymer or polymers. It is also possible to pre-mix the size dispersion with a retention aid, e.g. a cationic polymer like cationic starch or a cationic acrylamide-based polymer, or an anionic silica-based material, prior to introducing the mixture thus obtained into the stock.

In a preferred embodiment of this invention, the aqueous dispersion contains a cellulose-reactive sizing agent, as defined above, and an anionic hydrophobically modified cellulose-derivative, and the invention also relates to such a dispersion and its preparation, as further defined in the claims. These dispersions are preferably anionic. Suitable cellulose-derivatives include any compound derived from cellulose that is anionic and hydrophobically modified and capable of functioning as a dispersing agent or stabilizer. The cellulose-derivative preferably is water-soluble or water-dispersible. The cellulose-derivative contains one or more hydrophobic groups. Examples of suitable groups include hydrophobic substituents containing from 4 to about 30 carbon atoms, notably hydrophobic amide, ester and ether substituents comprising a saturated or unsaturated hydrocarbon chain of at least 4, suitably a least 6 and preferably from 8 to 30 carbon atoms, optionally being interrupted by one or more heteroatoms, e.g. oxygen or nitrogen, and/or groups containing a heteroatom, e.g. carbonyl or acyloxy. Fatty amide-modified celluloses are preferred. The cellulose-derivative can have a degree of hydrophobic substitution ($DS_M$) of from 0.01 to 0.8, suitably from 0.02 to 0.5 and preferably from 0.03 to 0.4. The hydrophobe-modified cellulose-derivative is anionic and contains one or more anionic groups of the same or different type, preferably it is polyanionic. Suitable anionic groups, i.e. groups that are anionic or rendered anionic in water, include sulfate groups and carboxylic, sulfonic phosphoric and phosphoric acid groups which may be present as free acid or as water-soluble ammonium or alkali metal (generally sodium) salts. Anionic groups can be introduced by means of chemical modification in known manner. The cellulose-derivative can have a degree of anionic substitution ($DS_A$) of from 0.1 to 1.4, suitably from 0.4 to 0.9 and preferably from 0.5 to 0.8. The cellulose-derivatives suitably contain carboxyalkyl and preferably carboxymethyl groups.

Examples of suitable cellulose-derivatives according to the invention include hydrophobically modified and optionally charged, preferably anionic, cellulose-derivatives selected from carboxymethyl cellulose (CMC), mixed cellulose ethers of CMC, e.g. hydroxyethyl carboxymethyl cellulose (HECMC), hydroxypropyl carboxymethyl cellulose (HPCMC), dihydroxypropyl carboxymethyl cellulose (DHPCMC), quaternary nitrogen-containing carboxymethyl cellulose (QNCMC), e.g. CMC etherified with glycidyl trialkyl ammonium chloride, carboxymethyl ethylsulphonate cellulose (CMESC), methyl carboxymethyl cellulose (MCMC), etc. Fatty amide-modified carboxyl-containing celluloses are particularly preferred, e.g. fatty amide-modified carboxymethyl celluloses (FACMC). Suitable hydrophobically modified cellulose-derivatives and methods of introducing hydrophobic substituents into anionic cellulose-derivatives are for example disclosed in International Pat. Appl. Publ. No. WO 94/24169, which is incorporated herein by reference.

The hydrophobically modified cellulose-derivative can be present in the dispersion in an amount of up to 100% by weight, usually from 0.1 to 20% by weight, suitably from 0.2 to 10% by weight and preferably from 0.3 to 6% by weight, based on the cellulose-reactive sizing agent.

It has been found that the dispersions according to the invention can be prepared in high solids contents and yet exhibit very good stability on storage. This invention provides sizing dispersions with improved storage stability and/or high solids content. The present dispersions generally can have sizing agent contents of from about 0.1 to about 45% by weight. Dispersions containing a ketene dimer sizing agent according to the invention may have ketene dimer contents within the range of from 5 to 45% by weight and preferably from about 10 to about 35% by weight. Dispersions, or emulsions, containing an acid anhydride sizing agent according to the invention may have acid anhydride contents within the range of from about 0.1 to about 30% by weight and preferably from about 5 to about 20% by weight.

The dispersions of this invention can be produced by mixing an aqueous phase with the dispersing agent and the sizing agent, and optionally the surfactant, preferably at a temperature where the sizing agent is liquid, and homogenizing the mixture so obtained, suitably under pressure. Suitable temperatures for ketene dimer sizing agents are from about 55° C. to 95° C. whereas lower temperatures can be employed for acid anhydrides. The obtained emulsion, which contains droplets of sizing agent normally having a size of from 0.1 to 3 $\mu$m in diameter, is then cooled. In addition to the above-mentioned components other materials can also be incorporated into the size dispersions, such as, for example, dispersing agents and stabilizer, extenders, e.g. urea and urea derivatives, and preservative agents.

It has further been found that the components of the dispersions can be easily homogenized in the presence of an aqueous phase. Therefore, a further method of preparing the dispersions comprises (i) mixing the cellulose-reactive sizing agent with the anionic cellulose-derivative, and optionally the surfactant, to obtain an intermediate composition, and (ii) homogenizing the intermediate composition in the presence of an aqueous phase, as described above. It is preferred that the components are homogeneously mixed in stage (i). The sizing agent used in stage (i) may be solid although it is preferred that it is liquid in order to simplify homogeneous mixing. If desired, the intermediate composition can be removed after the mixing stage (i), and optionally be cooled for solidification, to form a substantially water-free intermediate size composition which enables simplified shipping in an economically attractive manner. At the location of intended se, or elsewhere, the intermediate size composition can be homogenized in the presence of water in conventional manner, optionally at elevated temperature so as to render the intermediate size composition liquid. This method is especially attractive when preparing dispersions of ketene dimers and acid anhydrides, the latter of which usually being prepared in the paper mill in direct connection to its use as a sizing agent in the production of paper. The provision of a storage-stable substantially water-free size composition thus offers considerable economic and technical benefits. The present invention thus also relates to a substantially water-free size composition comprising a cellulose-reactive sizing agent and an anionic hydrophobically modified cellulose-derivative, and optionally a surfactant, its preparation and use, as further defined in the claims.

The components that are present in the composition according to the invention, i.e., the cellulose-reactive sizing agent and the anionic hydrophobically modified cellulose-derivative, and optionally the surfactant, preferably are as defined above. The composition is substantially water-free and hereby is meant that a small amount of water can be present; the water content can be from 0 up to 10% by weight, suitably less than 5% by weight and preferably less than 2%. Most preferably it contains no water. The composition preferably contains the cellulose-reactive sizing agent in a predominant amount, based on weight, i.e. at least 50% by weight, and suitably the composition has a sizing agent content within the range of from 80 to 99.9% by weight and preferably from 90 to 99.7% by weight. The cellulose-derivative can be present in the size composition in amounts defined above with respect to the dispersions where the percentages are based on the sizing agent. The anionic cellulose-derivative can thus be present in the composition in an amount of up to 100% by weight, usually from 0.1 to 20% by weight, suitably from 0.2 to 10% by weight and preferably from 0.3 to 5% by weight, based on the sizing agent. If being used, the surfactant, which suitably is a cationic surfactant, can be present in the composition in an amount of from 0.1 to 20% by weight, suitably from 1 to 10% by weight and preferably from 2 to 7% by weight, based on the sizing agent, wherein the overall charge of the surfactant and the anionic cellulose-derivative being present in the composition preferably is anionic or negative.

The sizing dispersions according to the invention can be used in conventional manner in the production of paper using any type of cellulosic fibers and it can be used both for surface sizing and internal or stock sizing. The present invention also relates to a method for the production of paper in which an aqueous dispersion, as defined above, is used as a surface or stock size. Suitably the amount of cellulose-reactive sizing agent either added to the stock containing cellulosic fibers, and optional fillers, or applied on the paper surface as a surface size, usually at the size press, is from 0.01 to 1.0% by weight, based on the dry weight of cellulosic fibers and optionally fillers, preferably from 0.05 to 0.5% by weight, where the dosage is mainly dependent on the quality of the pulp or paper to be sized, the cellulose-reactive sizing agent used and the level of sizing desired.

The dispersions of this invention are particularly useful in stock sizing of cellulosic pulp where the stock has as high cationic demand and/or contains substantial amounts of lipophilic substances. Suitable levels of the cationic demand, contents of lipophilic extractives and levels of fresh water introduced into the process are described above.

The invention is further illustrated in the following examples, which, however, are not intended to limit the same. Parts and % relate to parts by weight and % by weight, respectively, unless otherwise stated.

EXAMPLE 1

Alkyl ketene dimer (AKD) dispersions according to the invention were prepared by mixing an aqueous solution of an anionic hydrophobe-modified cellulose-derivative with molten AKD at 70° C., passing the mixture through a homogenizer and then cooling the dispersion so obtained. The pH of the dispersion was adjusted to about 5 by addition of acid.

Dispersion No. 1 was prepared using an anionic fatty amide-modified carboxymethyl cellulose (FACMC) containing a hydrophobic substituent derived from N-hydrogenated tallow-1,3-diaminopropan prepared according to the disclosure of WO 94/24169. The FACMC had a degree of carboxylic substitution of 0.6 and a degree of hydrophobic substitution of 0.1. The dispersion contained AKD particles with an average particle size of about 1 $\mu$m, had an AKD content of 30% and contained 1.5% by weight of FACMC, based on the AKD.

Dispersion No. 2 was prepared as above except that a cationic surfactant, di(hydrogenated tallow) dimethylammonium chloride, commercially available under the trade name Querton 442, Akzo Nobel, was also present during the homogenization. The dispersion contained AKD particles with an average particle size of about 1 $\mu$m which were anionically charged, as shown by a negative zeta potential determined by means of a ZetaMaster S Version PCS. The AKD content was 30%. Dispersion No. 2 contained 3% by weight of cationic surfactant and 1% by weight of FACMC, both based on the AKD.

EXAMPLE 2

Sizing efficiency of Dispersion No. 1 according to Example 1 was evaluated in this Example. An anionic AKD dispersion was also prepared by using carboxymethyl cellulose as a dispersing agent (5% by weight of CMC, based on the AKD) and tested for comparison purposes. This dispersion, Ref. 1, showed poor stability and was therefore used immediately after its preparation.

Paper sheets were prepared according to the standard method SCAN-C23X for laboratory scale. The papermaking stock used contained 80% of 60:40 bleached birch/pine sulphate and 20% of chalk to which 0.3 g/l of $Na_2SO_4.10H_2O$ was added. Stock consistency was 0.5% and pH 8.0. The size dispersions were used in conjunction with a commercial retention and dewatering system, Compozil™, comprising cationic starch and an anionic aluminium-modified silica sol which were added to the stock separately; the cationic starch was added in an amount of 8 kg/ton, based on dry stock, and the silica sol was added in an amount of 0.8 kg/ton, calculated as $SiO_2$ and based on dry stock.

Cobb values, measured according to TAPPI standard T 441 OS-63, obtained in the tests are set forth in Table 2. The dosage of AKD is based on dry stock.

TABLE 1

| Dispersion No. | AKD dosage [kg/ton] | Cobb 60 [g/m$^2$] |
|---|---|---|
| 1 | 0.4 | 67 |
| 1 | 0.6 | 28 |
| 1 | 0.8 | 24 |
| Ref. 1 | 0.4 | 80 |
| Ref. 1 | 0.6 | 62 |
| Ref. 1 | 0.8 | 50 |

Table 1 demonstrates the improvement in paper sizing obtained with the anionic size dispersion according to the invention.

EXAMPLE 3

Sizing efficiency of Dispersion No. 2 according to Example 1 was evaluated and compared to a conventional anionic AKD dispersion, Ref. 2, containing a dispersant system consisting of sodium lignosulphonate and cationic starch where the lignosulphonate is present ionic excess.

The procedure of Example 2 was repeated except that the stock contained precipitated calcium carbonate as a filler instead of chalk, and the dosage of cationic starch was 12 kg/ton, based on dry stock. In some of the tests 10 ppm of stearic acid was added to the stock in order to raise the cationic demand and the lipophilic substance content of the stock and to create conditions similar to those obtained with extensive white water recirculation. The results are set forth in Table 2.

TABLE 2

| Dispersion No. | AKD dosage [kg/ton] | Stearic acid [ppm] | Cobb 60 [g/m$^2$] |
|---|---|---|---|
| 2 | 0.45 | — | 32 |
| 2 | 0.60 | — | 28 |
| 2 | 0.75 | — | 26 |
| 2 | 0.45 | 10 | 62 |
| 2 | 0.60 | 10 | 36 |
| 2 | 0.75 | 10 | 27 |
| Ref. 2 | 0.45 | — | 50 |
| Ref. 2 | 0.60 | — | 32 |
| Ref. 2 | 0.75 | — | 30 |
| Ref. 2 | 0.45 | 10 | 103 |
| Ref. 2 | 0.60 | 10 | 76 |
| Ref. 2 | 0.75 | 10 | 35 |

As is evident from Table 2, Dispersion No. 2 according to the invention generally gave much better sizing than the anionic dispersion Ref. 2 used for comparison, and considerably improved sizing effect was obtained when the stock had a higher cationic demand and contained a substantial amount of lipophilic substances.

What is claimed is:

1. An aqueous dispersion of a sizing agent comprising a cellulose-reactive sizing agent and anionic hydrophobically modified cellulose-derivative dispersing agent.

2. The dispersion of claim 1, wherein the cellulose-derivative contains a hydrophobic group containing from 4 to about 30 carbon atoms.

3. The dispersion of claim 1, wherein the cellulose-derivative contains a hydrophobic amide, hydrophobic ester or hydrophobic ether substituent comprising a saturated or unsaturated hydrocarbon chain of at least 8 carbon atoms, optionally being interrupted by one or more heteroatoms and/or one or more groups containing a heteroatom.

4. The dispersion of claim 3, wherein the cellulose-derivative is a fatty amide-modified carboxymethyl cellulose.

5. The dispersion of claim 1, wherein the sizing agent is a ketene dimer or an acid anhydride.

6. The dispersion of claim 1, wherein the dispersion is anionic.

7. A method for preparing the dispersion of claim 1, which comprises homogenizing the cellulose-reactive sizing agent in the presence of an aqueous phase and the anionic hydrophobically modified cellulose-derivative.

8. The method of claim 7, which comprises providing a substantially water-free composition containing the cellulose-reactive sizing agent and the anionic hydrophobically modified cellulose-derivative and homogenizing the composition in the presence of the aqueous phase.

9. A substantially water-free composition containing a cellulose-reactive sizing agent and an anionic hydrophobically modified cellulose-derivative effective as a dispersing agent.

10. The composition of claim 9, wherein the sizing agent is a ketene dimer or an acid anhydride.

* * * * *